US005085335A

United States Patent [19]

Carbaugh

[11] Patent Number: 5,085,335

[45] Date of Patent: Feb. 4, 1992

[54] DRINKING CUP APPARATUS

[76] Inventor: Donna Carbaugh, 15 Page St., Las Vegas, Nev. 89110

[21] Appl. No.: 663,678

[22] Filed: Mar. 4, 1991

[51] Int. Cl.[5] ..... A47G 19/22

[52] U.S. Cl. ..... 220/709; 215/1 A; 239/33; 426/85; 426/87; 426/115

[58] Field of Search ..... 220/90.2, 90.4, 90.6; 215/1 A; 239/28, 33; 426/85, 87, 115

[56] References Cited

U.S. PATENT DOCUMENTS

| | | | |
|---|---|---|---|
| 1,000,332 | 8/1911 | Dyer | 239/33 X |
| 2,052,496 | 8/1936 | Stassi | 239/33 X |
| 2,867,536 | 1/1959 | Mead et al. | 426/85 |
| 2,948,453 | 8/1960 | Drown | 215/1 A X |
| 3,106,312 | 10/1963 | Hitchcock | 215/1 A |

*Primary Examiner*—Gary E. Elkins
*Assistant Examiner*—Nova Stucker
*Attorney, Agent, or Firm*—Leon Gilden

[57] ABSTRACT

A drinking cup defining a cup-shaped base, including an upper terminal end securably mounting a lid thereon, wherein the lid includes a guide bore directed coaxially of the lid and aligned with an axis defined by the cup. A drinking tube is slidably directed through the bore, with the drinking tube including an abutment formed about the tube below the bore. A modification of the invention includes the abutment formed of an upper and lower cup-shaped disk member defining a cavity therebetween, wherein the cavity is arranged to receive a fluid soluble food component therewithin for enhancing flavor of fluid directed through the tube.

1 Claim, 5 Drawing Sheets

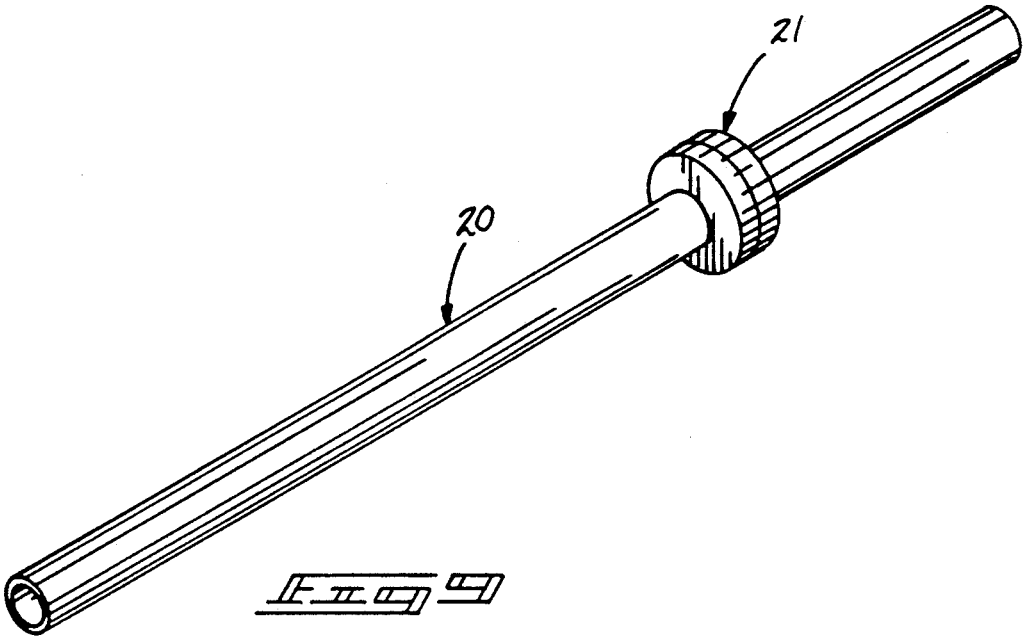
Fig 9
Fig 10
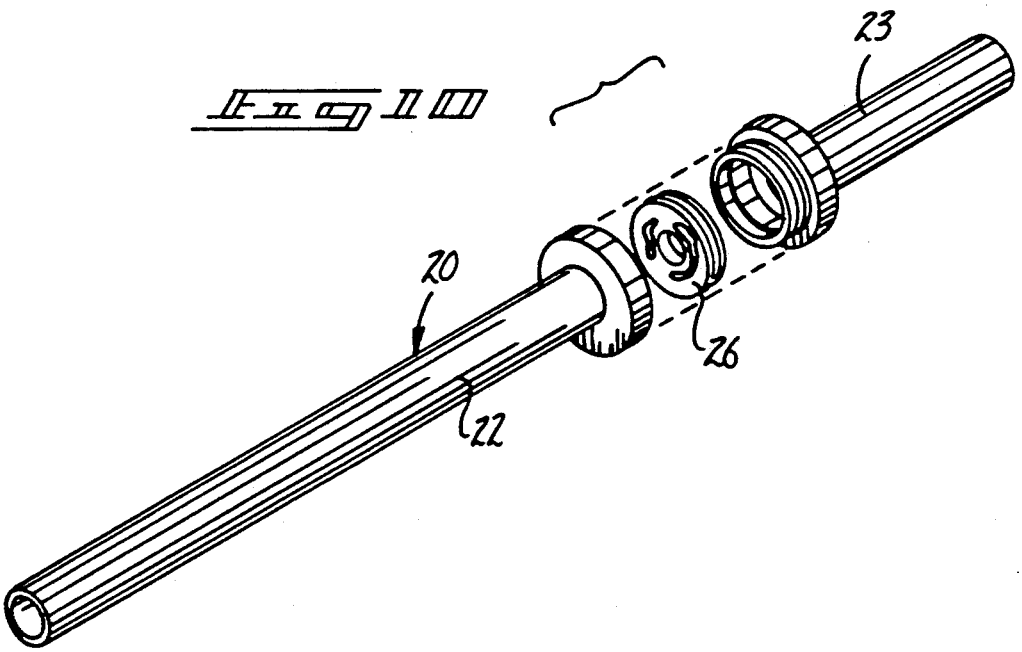

DRINKING CUP APPARATUS

BACKGROUND OF THE INVENTION

1. Field of the Invention

The field of invention relates to drinking cup apparatus, and more particularly pertains to a new and improved drinking cup apparatus wherein the same provides for a cup member simulating a clown-like figure to enhance enjoyment and entertainment of an individual utilizing the apparatus.

2. Description of the Prior Art

Various drinking cup structure of figure simulating configurations have been provided in the prior art to enhance interest of an individual, particularly that of a child, utilizing the cup. Examples of the prior art include U.S. Pat. No. Des. 244,167 illustrating such an example of a cup formed with a predetermined figure simulation.

U.S. Pat. No. 2,893,592 to Barradas sets forth a drinking cup formed with a predetermined configuration thereabout, wherein the drinking cup further includes retractable legs telescopingly receivable within the cup dependent upon a predetermined quantity of fluid positioned within the cup.

U.S. Pat. No. 2,903,818 to Humke provides for a drinking glass, wherein the drinking glass includes a novel passageway directed through a bottom base of the cup for amusement and entertainment of a child utilizing the cup structure.

U.S. Pat. No. 2,689,424 to Clagett sets forth a dual indicia container, wherein the container is formed with a pluarlity of indicia mounted thereon dependent upon the presence or absence of fluid for permitting visual observation of a fist or second indicia formed about the cup exterior surface.

U.S. Pat. No. 4,654,274 to Demars sets forth an organization arranged for mounting cups therebetween, wherein the configuration includes a clown-like member defining a handle mounting upper and lower support elements for maintaining a cup between the elements.

As such, it may be appreciated that there continues to be a need for a new and improved drinking cup apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of drinking cup apparatus now present in the prior art, the present invention provides a drinking cup apparatus wherein the same slidably and nonremovably mounts a straw coaxially of the drinking cup structure. As such, the general purpose of the present invention, which will be described subsequently in greater detail, is to provide a new and improved drinking cup apparatus which has all the advantages of the prior art drinking cup apparatus and none of the disadvantages.

To attain this, the present invention provides a drinking cup defining a cup-shaped base, including an upper terminal end securably mounting a lid thereon, wherein the lid includes a guide bore directed coaxially of the lid and aligned with an axis defined by the cup. A drinking tube is slidably directed through the bore, with the drinking tube including an abutment formed about the tube below the bore. A modification of the invention includes the abutment formed of an upper and lower cup-shaped disk member defining a cavity therebetween, wherein the cavity is arranged to receive a fluid soluble food component therewithin for enhancing flavor of fluid directed through the tube.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limited as to the scope of the invention in any way.

It is therefore an object of the present invention to provide a new and improved drinking cup apparatus which has all the advantages of the prior art drinking cup apparatus and none of the disadvantages.

It is another object of the present invention to provide a new and improved drinking cup apparatus which may be easily and efficiently manufactured and marketed.

It is a further object of the present invention to provide a new and improved drinking cup apparatus which is of a durable and reliable construction.

An even further object of the present invention is to provide a new and improved drinking cup apparatus which is susceptible of a low cost of manufacture with regard to both materials and labor, and which accordingly is then susceptible of low prices of sale to the consuming public, thereby making such drinking cup apparatus economically available to the buying public.

Still yet another object of the present invention is to provide a new and improved drinking cup apparatus which provides in the apparatuses and methods of the prior art some of the advantages thereof, while simultaneously overcoming some of the disadvantages normally associated therewith.

Still another object of the present invention is to provide a new and improved drinking cup apparatus wherein the same coaxially positions a drinking tube of the cup apparatus and further permits the use of flavor enhancing food components to be positioned within a chamber formed within the drinking tube.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annex drawings wherein:

FIG. 9 is an isometric illustration of a modified drinking tube utilized by the instant invention.

FIG. 10 is an isometric illustration of the modified drinking tube in an exploded configuration relative to the various component parts thereof.

DESCRIPTION OF THE PREFERRED EMBODIMENT

Figure 1:
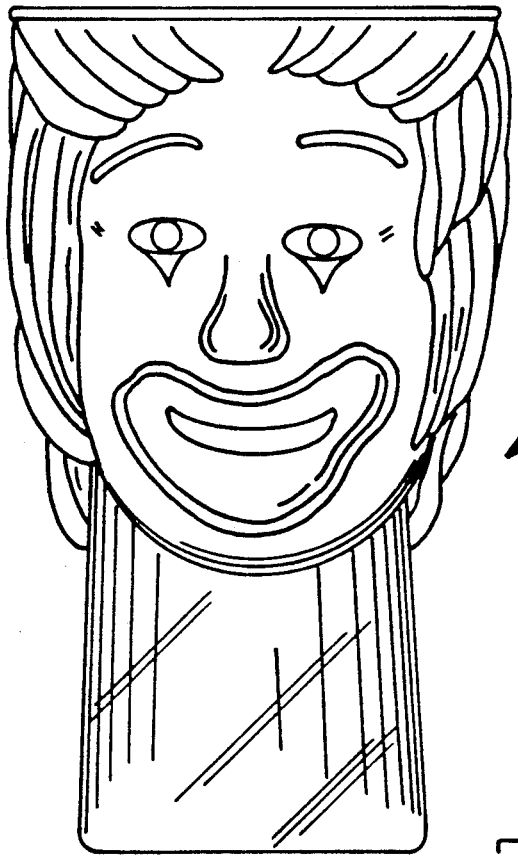
Fig 1 PRIOR ART
FIG. 1 is an orthographic frontal view, taken in elevation, of a prior art drinking cup.

With reference now to the drawings, and in particular to FIGS. 1 to 10 thereof, a new and improved drinking cup apparatus embodying the principles and concepts of the present invention and generally designated by the reference numeral 10 will be described.

Figure 2:
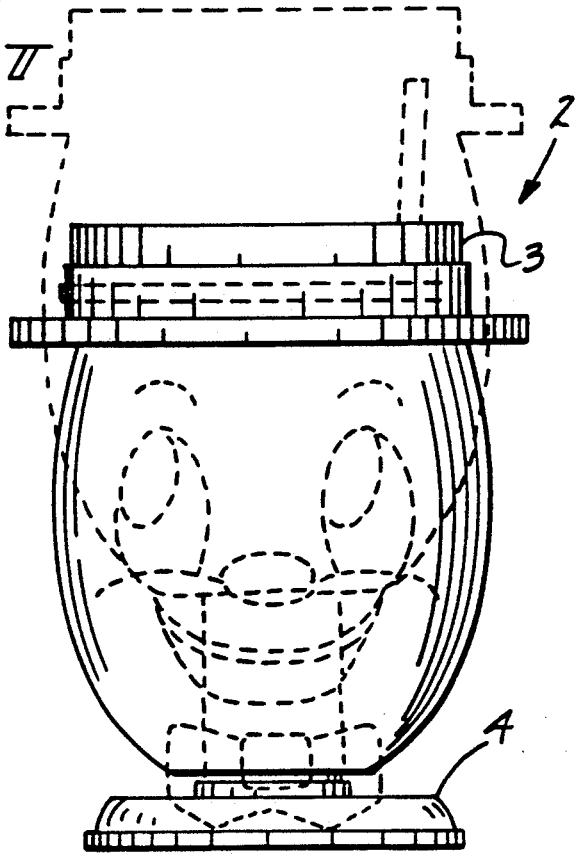
Fig 2 PRIOR ART
FIG. 2 is an orthographic frontal view, taken in elevation, of a further example of a prior art drinking cup apparatus.
Figure 3:
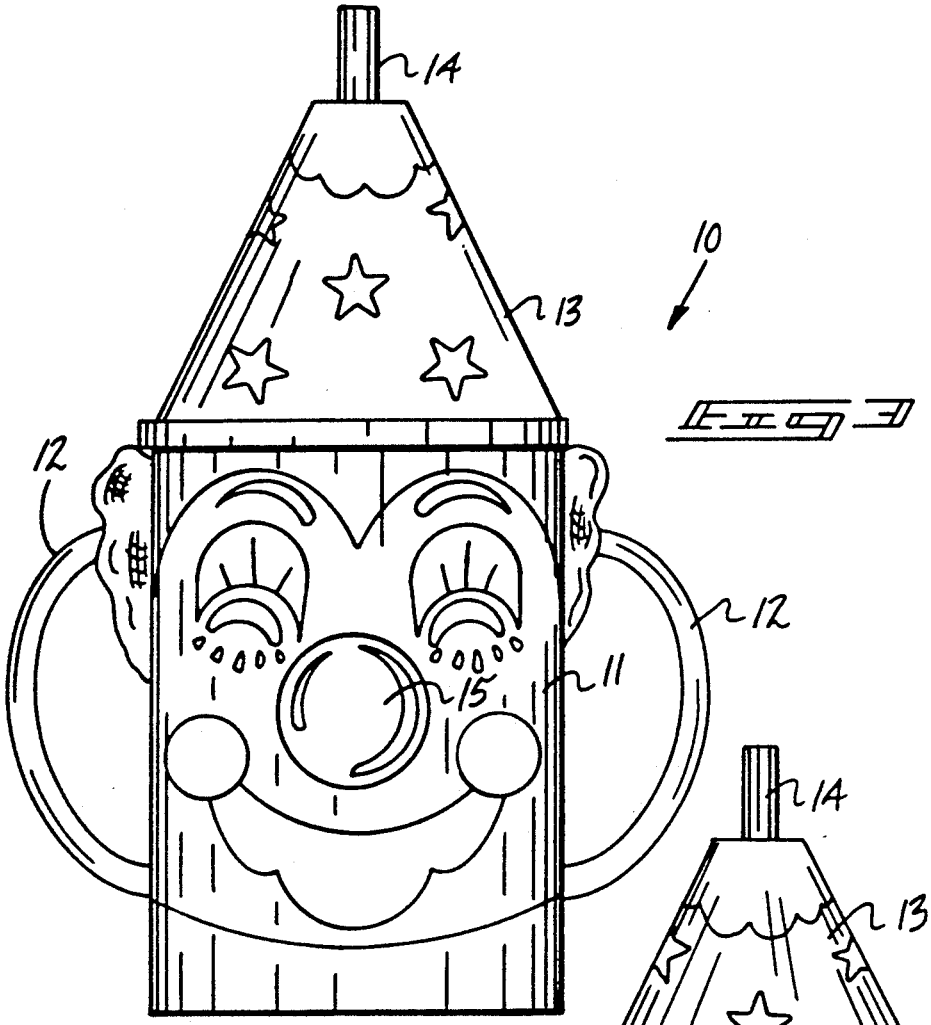
FIG. 3 is an orthographic frontal view, taken in elevation, of the instant invention.
Figure 4:
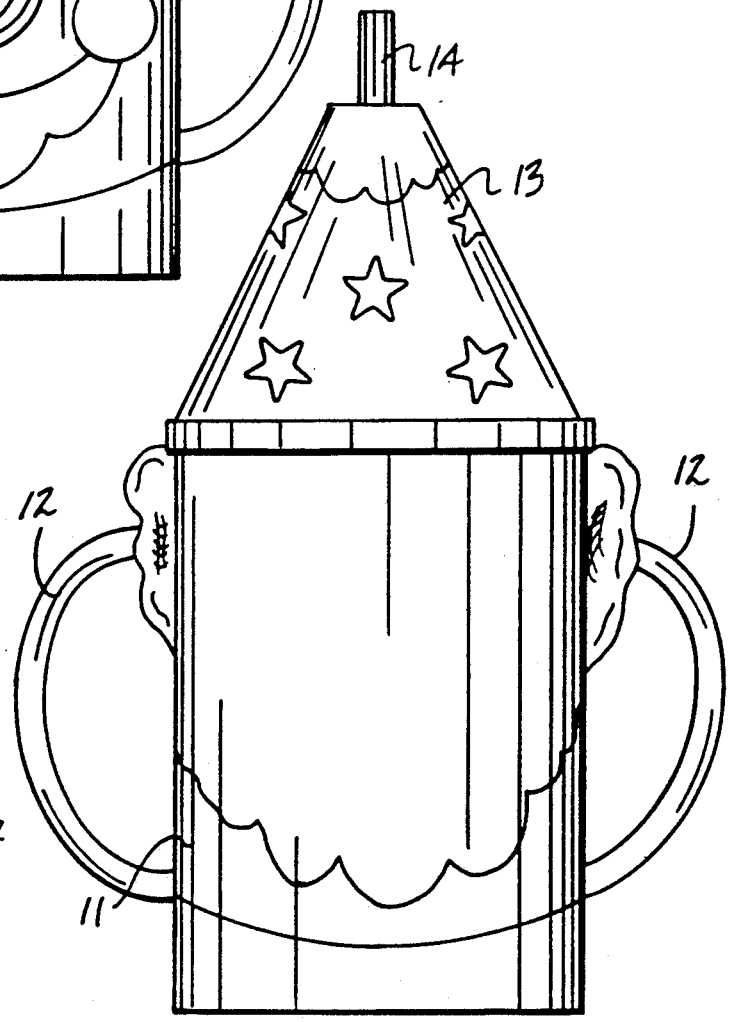
FIG. 4 is an orthographic rear view, taken in elevation, of the invention.
Figure 5:
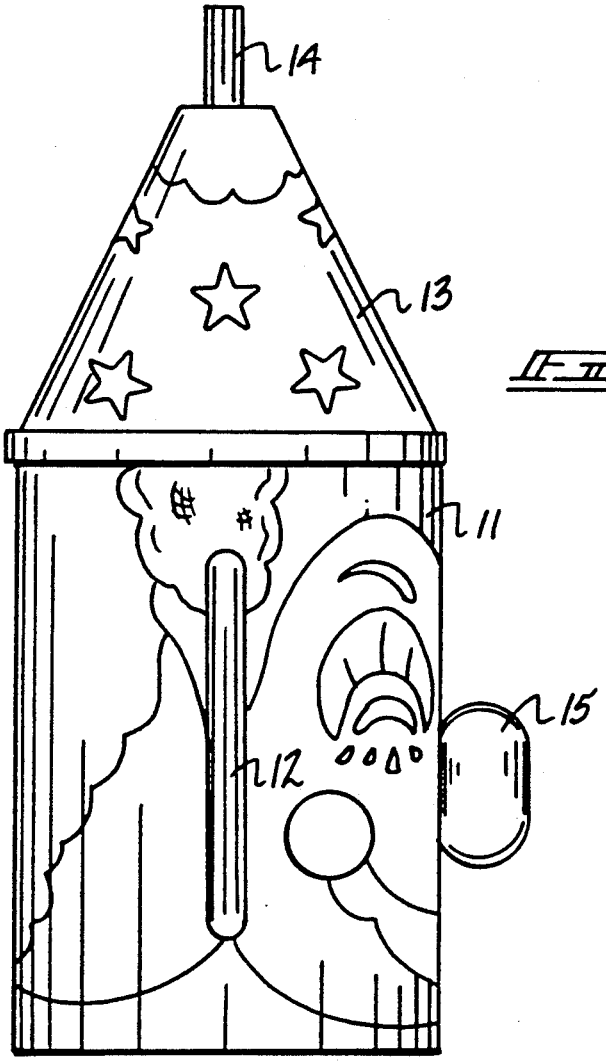
FIG. 5 is an orthographic side view, taken in elevation, of the invention.
Figure 6:
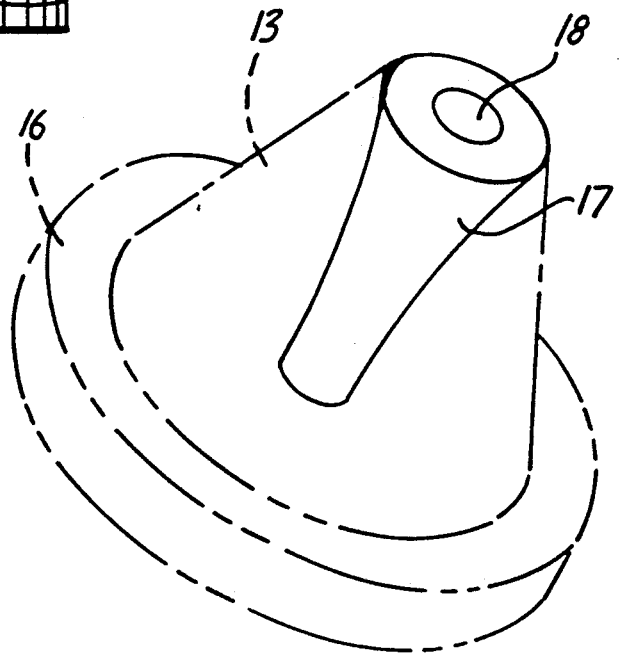
FIG. 6 is an isometric illustration, partially in phantom, of the drinking lid utilized by the instant invention.
Figure 7:
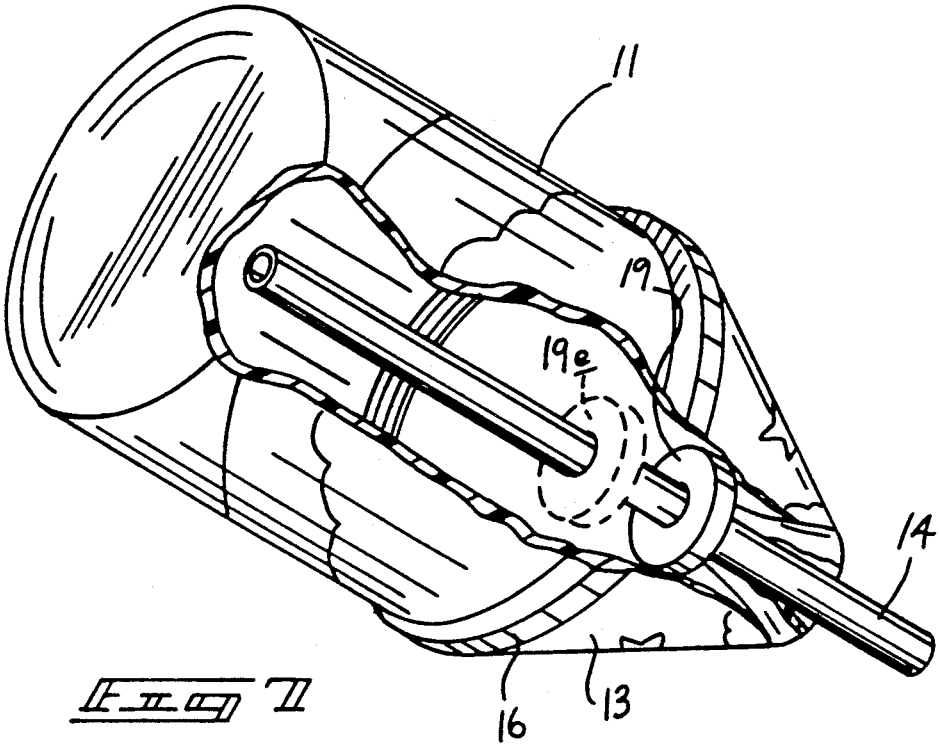
FIG. 7 is an isometric illustration, partially in section, of the instant invention illustrating various components thereof, their configuration, and relationship.
Figure 8:
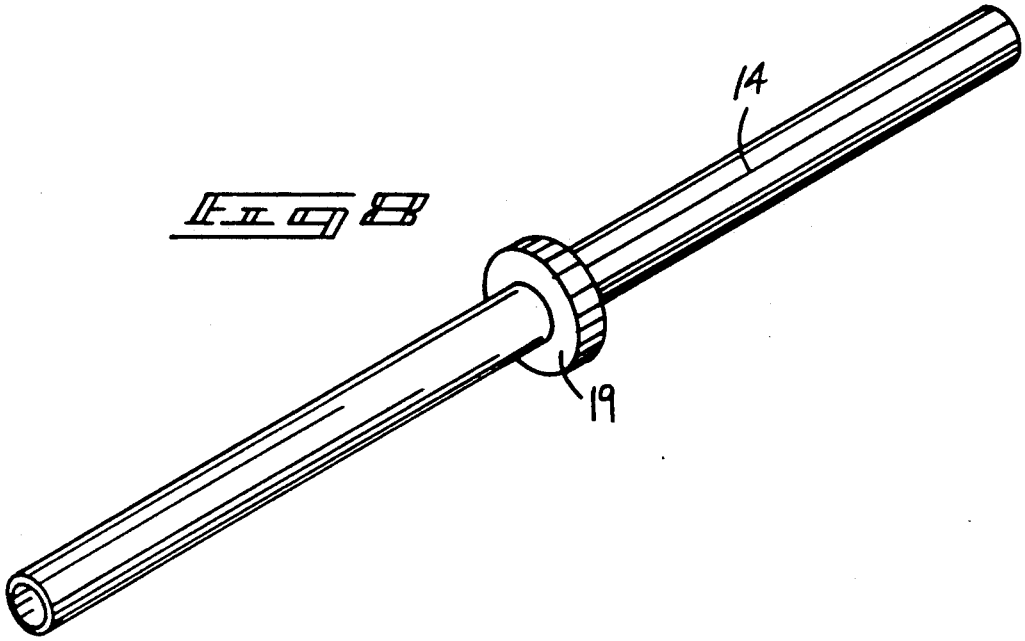
FIG. 8 is an isometric illustration of the drinking tube utilized by the instant invention.

FIG. 1 illustrates a prior art drinking cup organization 1, in a manner as set forth in U.S. Pat. No. Des. 244,167, formed with an integral clown-like configuration formed thereabout. FIG. 2 illustrates a further example of a prior art drinking cup apparatus 2, wherein the cup member 3 includes telescoping leg portions 4 coaxially received in the cup, wherein the leg portions are retractable therewithin dependent upon the quantity of fluid contained within the cup due to a spring biased relationship of the legs and the cup member, in a manner as set forth in U.S. Pat. No. 2,893,591.

More specifically, the drinking cup apparatus 10 of the instant invention essentially comprises a generally cylindrical cup-shaped member 11 symmetrically formed about a central cup axis, wherein diametrically opposed loop handles 12 are mounted on opposed sides exteriorly of the cup 11 to provide grasp handles. A projection knob 15 mounted exteriorly to the wall of the cup 11 is positioned circumferentially medially of the spaced loop handles 12 and vertically medially of the cup handles 12, as measured axially along an exterior surface of the cup 11 to provide an additional grasp handle for a child and the like for convenience in use. A conical lid member 13 that includes a cylindrical like skirt 16 to resiliently engage for securement to an upper terminal end of the cup 11 is mounted upon the cup 11, wherein the conical lid member 13 is coaxially aligned relative to the cup axis of a cup 11 and includes a flexible tubular guide 17 coaxially directed along the axial extent of the conical lid member 13, wherein the tubular guide 17 is formed with a cylindrical guide bore 18, wherein the guide bore 18 is formed of a predetermined bore diameter. A drinking tube 14 is slidably received through the guide bore 18, with the drinking tube 14 formed with a tube diameter less than the guide bore diameter to permit the sliding relationship of the tube 14 and the tubular guide 17. A cylindrical abutment disk (see FIG. 7) is fixedly mounted about the drinking tube 14 contiguous to and adjacent the tubular guide 17 to prevent removal of the drinking tube 14 when positioned in an assembled configuration relative to the lid member 13 and cup 11. Accordingly, the cylindrical abutment 19 is defined by an abutment diameter substantially greater than the bore diameter defined by the guide bore 18. The abutment 19 may optionally be positioned in a spaced relationship below the lower terminal edge of the tubular guide 17 at **19*a* (see FIG. 7) to permit angulated positioning of the drinking tuber 14 within the cup 11**.

FIGS. 9 and 10 illustrate a modified drinking tube 20 formed with a modified abutment disk 21, wherein the modified abutment disk 21 defines a lower drinking tube 22 and an upper drinking tube 23 that are coaxially aligned relative to the abutment disk 21. The abutment disk 21 as illustrated is formed to include an upper externally threaded cup-shaped disk member 24 and a lower internally threaded cup-shaped disk member 25 that are selectively securably together to define a disk cavity therebetween when in an assembled configuration. The disk cavity accommodates a flavored food component tablet 26 that is water soluble to provide flavor enhancement to fluid directed through the drinking tube 20.

As to the manner of usage and operation of the instant invention, the same should be apparent from the above disclosure, and accordingly no further discussion relative to the manner of usage and operation of the instant invention shall be provided.

With respect to the above description the, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drinking cup apparatus, comprising, a cup member symmetrically defined about a cup axis, including an upper terminal end, with a lid mounted to the upper terminal end, wherein the lid is symmetrically configured about the cup axis, and the lid including a guide bore coaxially directed through the lid, and a drinking tube slidably mounted through the guide bore, and wherein the guide bore is defined by a guide bore diameter and the drinking tube is defined by a tube diameter, wherein the tube diameter is less than the guide bore diameter, and wherein the lid includes a resilient annular skirt, the resilient annular skirt is securable about the upper terminal end of the cup member to frictionally secure the annular skirt and lid to the cup member, and wherein the guide bore includes a flexible tubular guide coaxially defined about the guide bore and fixedly mounted coaxially of the lid, and wherein the drinking tube includes an abutment disk fixedly mounted about the drinking tube below the tubular guide, wherein the abutment disk is defined by an abutment disk diameter greater than the guide bore diameter to prevent removal of the drinking tube when mounted within the cup member and the guide bore, and wherein the abutment disk includes an upper externally threaded cup-shaped disk and a lower internally threaded cup-shaped disk, the upper externally cup-shaped disk includes an upper drinking tube secured to the upper cup-shaped disk, and the lower drinking tube secured to the lower cup-shaped disk, wherein the upper and lower drinking tubes are coaxially aligned relative to one another, and the upper and lower cup-shaped disks define a disk cavity therebetween when the upper and lower disks are in an assembled configuration, and including a fluid soluble food component tablet positioned within the disk cavity to enhance flavor of fluid directed through the drinking tube.

* * * * *